United States Patent [19]

Fukutome et al.

[11] 4,351,041

[45] Sep. 21, 1982

[54] ACOUSTIC ALARM DEVICE FOR WATCHES

[75] Inventors: Satoru Fukutome; Hideo Hatanaka; Motoyuki Saito, all of Tanashi, Japan

[73] Assignee: Citizen Watch Co., Ltd., Tokyo, Japan

[21] Appl. No.: 164,769

[22] Filed: Jun. 30, 1980

[30] Foreign Application Priority Data

Jun. 30, 1979 [JP] Japan ..... 54-89820[U]
Jun. 30, 1979 [JP] Japan ..... 54-89821[U]
Jun. 30, 1979 [JP] Japan ..... 54-89822[U]

[51] Int. Cl.[3] ..... G04C 23/02; G04C 21/16
[52] U.S. Cl. ..... 368/88; 368/250
[58] Field of Search ..... 368/250, 255, 72, 73, 368/75, 315; 340/384 E, 388, 387

[56] References Cited

U.S. PATENT DOCUMENTS 3,777,472 12/1973 Iinuma ..... 368/255
3,879,931 4/1975 Yasuda et al. ..... 368/255
3,906,713 9/1975 Suda et al. ..... 368/255
4,197,697 4/1980 Mori et al. ..... 368/315
4,206,590 6/1980 Fukutome et al. ..... 368/72
4,250,573 2/1981 Saito ..... 340/387 X

FOREIGN PATENT DOCUMENTS 52-58959 5/1977 Japan ..... 368/250
52-75376 6/1977 Japan ..... 368/250

*Primary Examiner*—Vit W. Miska
*Attorney, Agent, or Firm*—Birch, Stewart, Kolasch & Birch

[57] ABSTRACT

An alarm device for a watch mounted in a recess provided in an upper portion of the watch case, for example in the upper portion of the band connecting portion of the watch case. The alarm device comprises a vibration plate secured to the bottom of the recess, a watertight sealing member, a cover for the vibration plate and securing means such as a screw for fixing the vibration plate to the recess through the watertight sealing member.

11 Claims, 27 Drawing Figures

ACOUSTIC ALARM DEVICE FOR WATCHES

BACKGROUND OF THE INVENTION

The present invention relates to an acoustic alarm device for watches.

It is desirable for miniaturizing a watch to provide the acoustic alarm device in an upper portion of the watch case which is not used for the watch movement or module, such as a band connecting portion of the watch case. However, the thickness of the alarm device must be decreased so as to be mounted in a thin portion of the watch case and moreover watertight means must be provided. Further, the alarm device must be constructed to be inserted into the watch case from the upper side thereof.

SUMMARY OF THE INVENTION

An object of the present invention is to provide a compact alarm device having perfect watertightness. Another object of the present invention is to provide an alarm device which may be mounted on a watch case.

Other objects will become more apparent from the following description with reference to the accompanying drawings.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
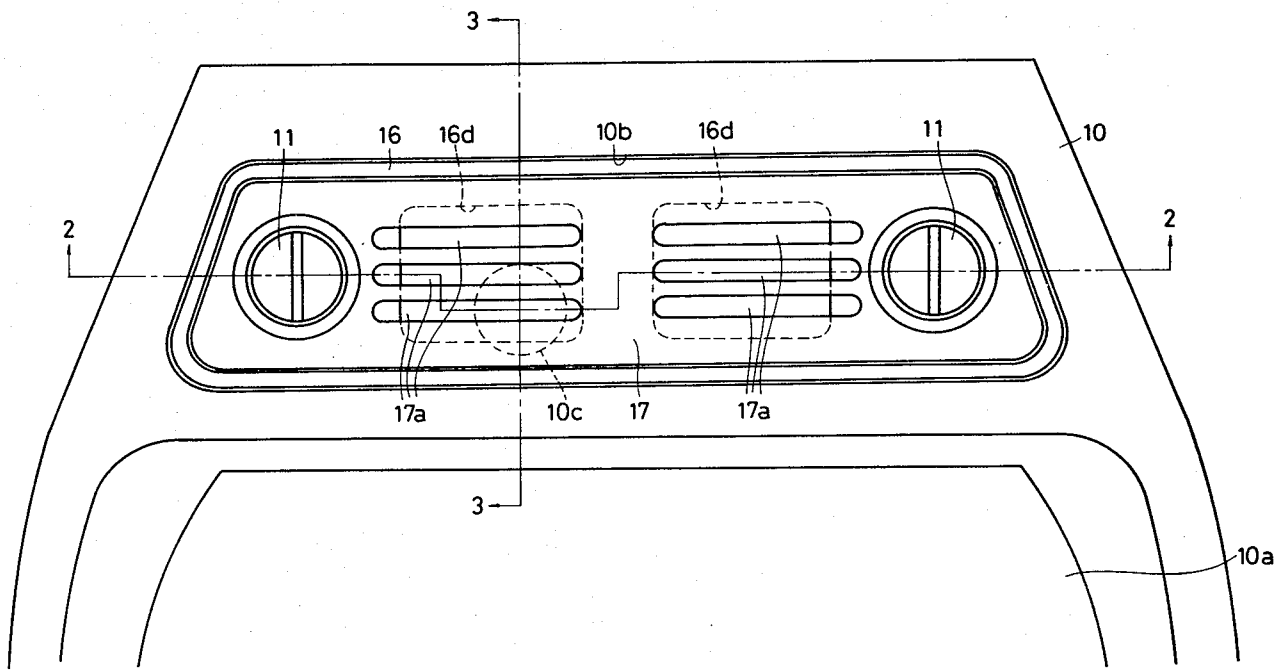
FIG. 1 is a front view of a first embodiment of the present invention.
Figure 2:
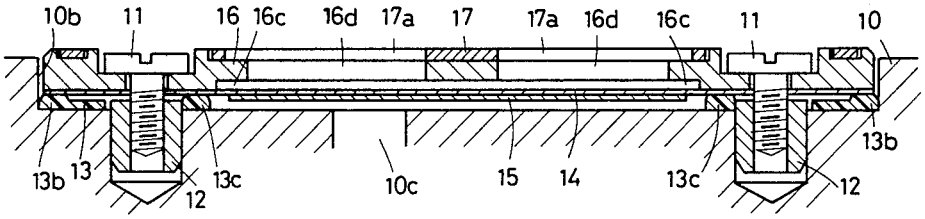
FIG. 2 is a sectional view taken along the line 2—2 of FIG. 1.
Figure 3:
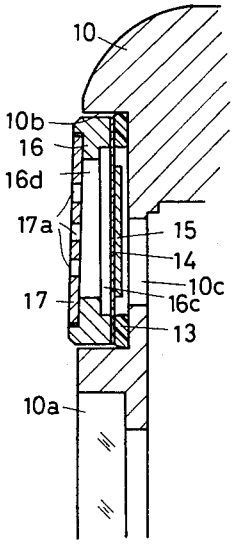
FIG. 3 is a sectional view taken along the line 3—3 of FIG. 1.

Referring to FIGS. 1 to 3, numeral 10 designates a watch case having a module (not shown) therein and a display portion 10*a* on an upper portion thereof. In an upper portion of a band-connecting portion of the watch case, an oblong recess 10*b* is provided for mounting an alarm device. A communication hole 10*c* is provided in the bottom of the recess 10*b* for electrical connection between the module in the watch case 10 and the alarm device in the recess. In the bottom of the recess 10*b*, threaded pipes 12 are securely provided at opposite ends of the bottom.

Figure 4:
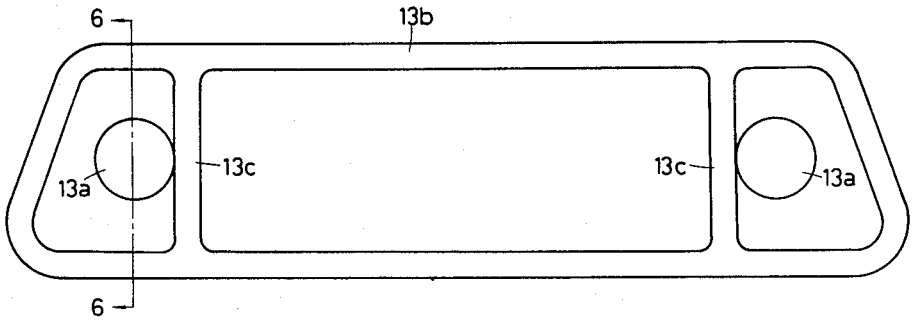
FIG. 4 is a front view of the packing.
Figure 5:
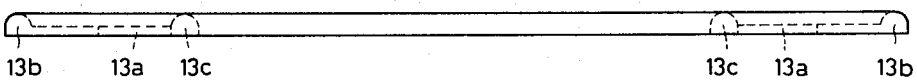
FIG. 5 is a side view of the packing.
Figure 6:
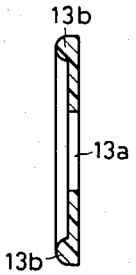
FIG. 6 is a sectional view taken along the line 6—6 of FIG. 4.

Numeral 13 designates a packing. As shown in FIGS. 4 to 6, the packing 13 comprises a peripheral portion 13*b* and a pair of inner portions 13*c* each of which surrounding a hole 13*a*. The packing has a watertight effect for the alarm device. Numeral 14 designates a vibration plate having a piezo-electric element 15 securely fixed to the underside thereof and having a pair of holes for securing screws 11.

Figure 7:
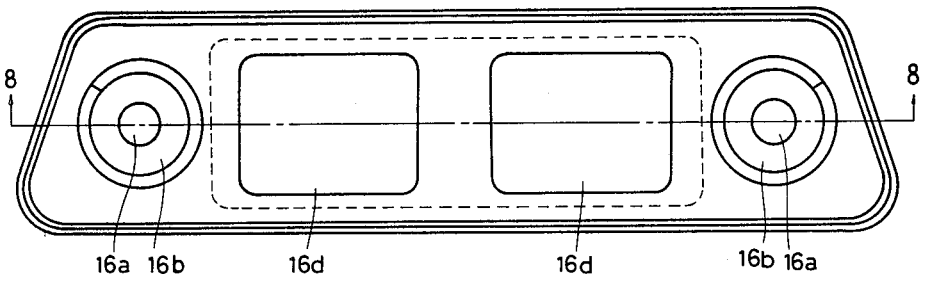
FIG. 7 is a front view of a cover.
Figure 8:
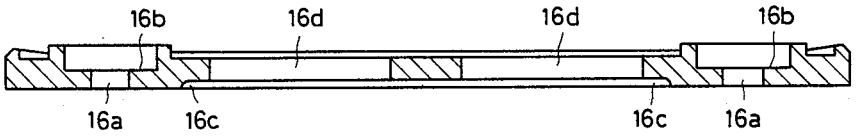
FIG. 8 is a sectional view taken along the line 8—8 of FIG. 7.
Figure 9:
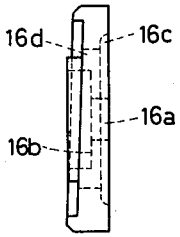
FIG. 9 is a right side view of the cover.

As shown in FIGS. 7 to 9, a cover 16 has holes 16*a* and recesses 16*b* for screws 11, and has on the underside an escape portion 16*c* to free an inner portion of the vibration plate 14. In the escape portion 16*c*, openings 16*d* are formed for transmitting the alarm sound therethrough. An ornament plate 17 is securely fixed on the cover 16 with adhesives or the like. The ornament plate has apertures 17*a* conveniently provided to correspond to openings 16*d*.

Therefore, assembly of the device described above is accomplished by putting the packing 13 on the bottom of the recess 10*b*, mounting the cover 16 subsequently to the vibration plate 14 on the packing 13, and fastening the engagement between screws 11 and screw pipes 12.

Thus, by the simple construction and flat disposition of elements of the alarm device, a compact alarm device can be made. Since the vibration plate 14 and the cover 16 are secured on the case 10 with screws 11 which extend through the packing 13, a watertight seal between the case 10 and the cover 16 is effected by the peripheral portion 13*b* of the packing 13 and the watertightness of the portion around the screws 11 to the inside of the watch case is perfectly ensured by the inner portions 13*c* of the packing 13.

Figure 10:
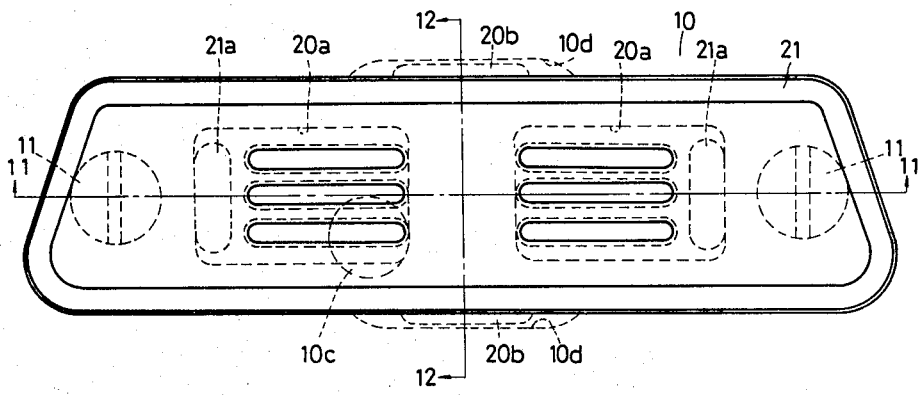
FIG. 10 is a front view of a second embodiment of the present invention.
Figure 11:
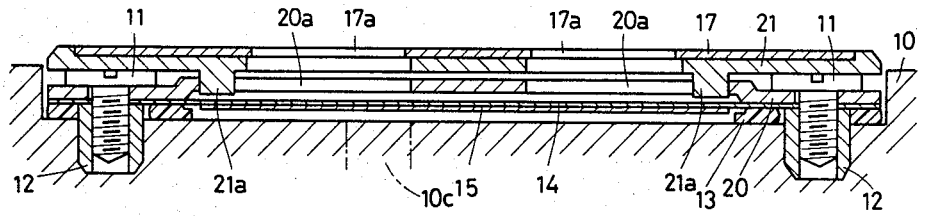
FIG. 11 is a sectional view taken along the line 11—11 of FIG. 10.
Figure 12:
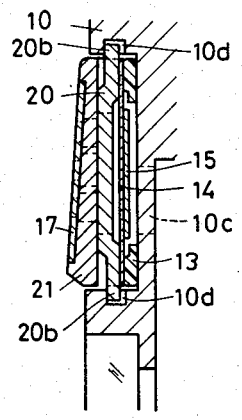
FIG. 12 is a sectional view taken along the line 12—12 of FIG. 10.

Referring to FIGS. 10 to 12 showing the second embodiment of the present invention, a member corresponding to the cover 16 of the first embodiment comprises a frame 20 and a cover 21. The frame 20 is secured by screws 11 and the cover 21 is secured to the frame 20 by pressing protrusions 21*a* extending from the underside of the cover 21 against the inside wall of sound emanating openings 20*a* formed in the frame 20. In this way, the face of watch case can be more excellently designed because the cover 21 covers the screws 11.

In this embodiment, protrusions 20*b* are provided on central portions of longitudinal sides of the frame 20, and notches 10*d* are formed in the case 10 to engage with the protrusions 20*b* respectively. Such engagement of protrusions 20*b* and notches 10*d* prevents the upward protruding of the center portions of frame 20, which is caused by clamping both ends of frame 20 by screws 11.

Figure 13:
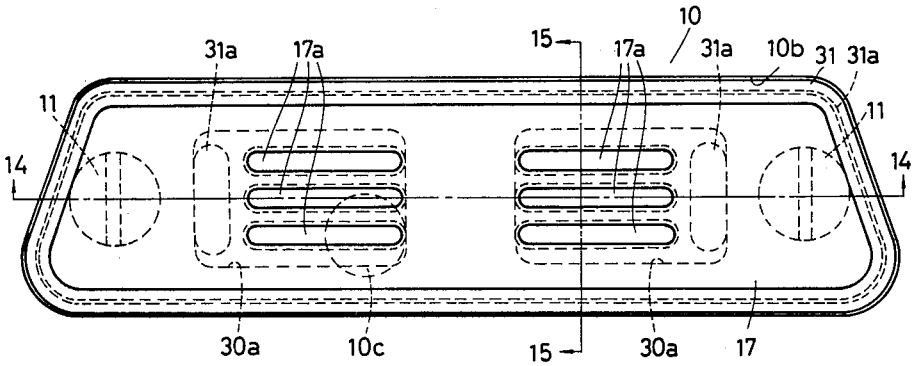
FIG. 13 is a front view of a third embodiment of the present invention.
Figure 14:
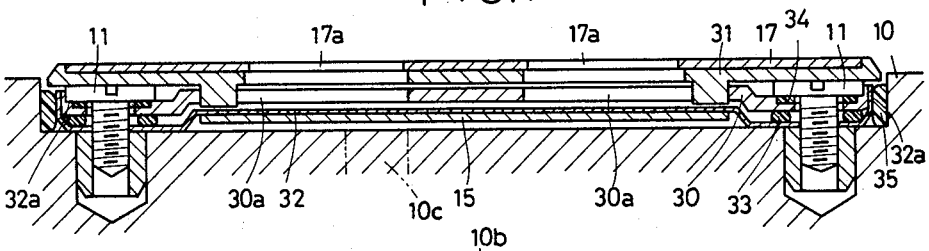
FIG. 14 is a sectional view taken along the line 14—14 of FIG. 13.
Figure 15:
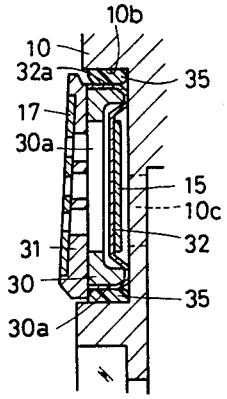
FIG. 15 is a sectional view taken along the line 15—15 of FIG. 13.

Referring to FIGS. 13 to 15 showing the third embodiment of the present invention, there is provided a frame 30 and a cover 31 similarly as in the second embodiment. Protrusions 31*a* of the cover 31 are pressed against inside walls of sound emanating openings 30*a* formed in the frame 30. A vibration plate 32 has a peripheral upright portion 32*a* which engages with the periphery of the frame 30. Two ring packings 33, 34 are disposed around the respective screw 11 at opposite sides of the frame 30. One of the packings 33 is disposed between the vibration plate 32 and the frame 30, and the other packing 34 is disposed between the frame 30 and the head of the screws 11. Further an annular packing 35 is disposed between the upright portion 32*a* of the vibration plate 32 and the recess 10*b* of the watch case 10. The packing 35 has a thickness larger than the gap between the inner wall of the recess 10*b* and the periphery of the upright portion 32*a* of the vibration plate 32.

Accordingly, when the frame 30 and the vibration plate 32 are secured on the watch case 10 by screws 11, the packings 33 and 34 are compressed, so that the watertight sealing around the screws 11 to the inside of the watch case 10 is effected. Also when the screws 11 are fastened, the packing 35 is pressed against the inner wall of the recess 10*b* by the upright portion 32 so that the watertightness between the watch case 10 and the upright portion 32*a* is ensured.

Figure 16:
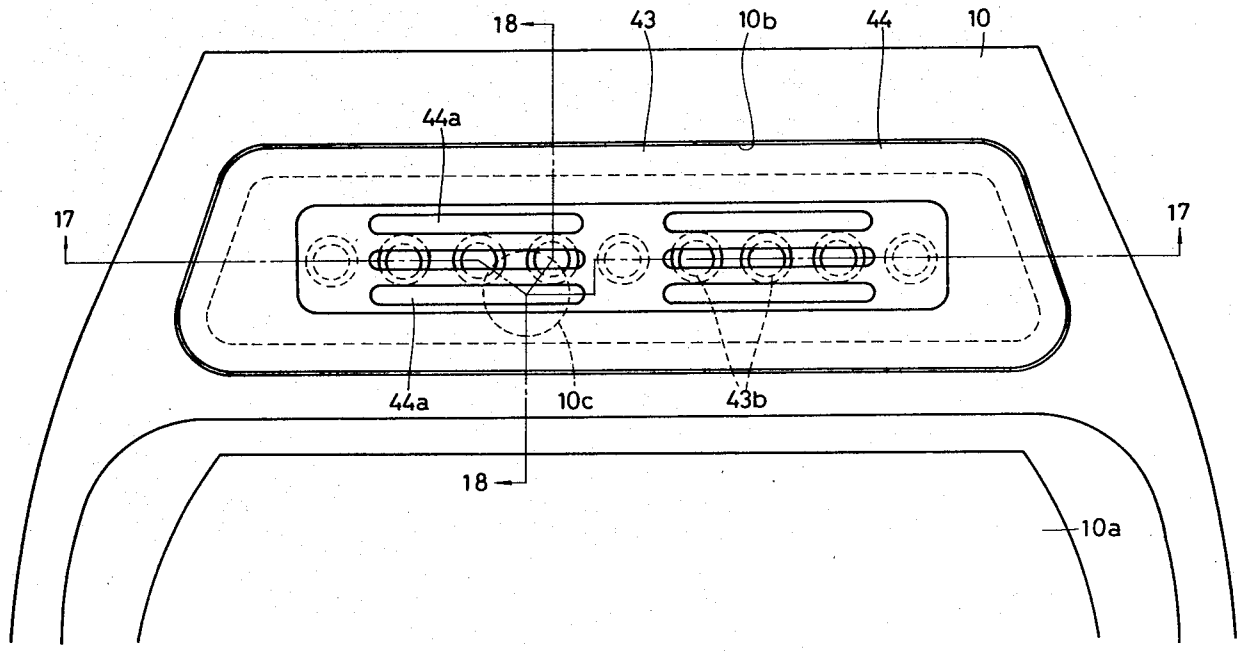
FIG. 16 is a front view of a fourth embodiment of the present invention.
Figure 17:
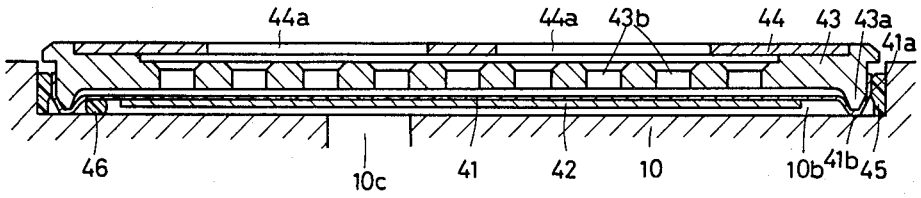
FIG. 17 is a sectional view taken along the line 17—17 of FIG. 16.
Figure 18:
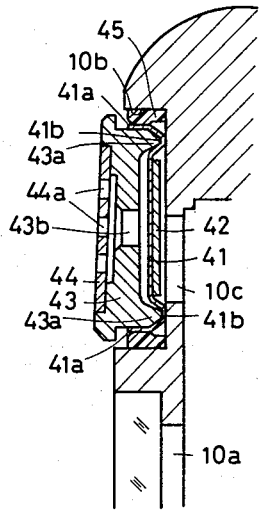
FIG. 18 is a sectional view taken along the line 18—18 of FIG. 16.
Figure 19:
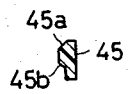
FIG. 19 is a sectional view of a packing.

The fourth embodiment shown in FIGS. 16 to 18 comprises a vibration plate 41 having a piezoelectric element 42, a cover 43, and an ornament plate 44. The vibration plate 41 has a peripheral upright portion 41*a* and a downwardly projected portion 41*b* adjacent the inside of the upright portion 41*a*. The cover 43 has a peripheral leg portion 43*a* engageable with the inside of the projected portion 41*b* of the vibration plate 41 and has a plurality of sound emanating holes 43*b*. The ornament plate 44 also has a plurality of sound emanating holes 44*a* communicating with the holes 43*b* of the cover 43. An annular packing 45 is disposed between the inner side wall of the recess 10*b* and the upright portion 41*a* of the vibration plate 41. The packing 45 has an inner diameter slightly smaller than the upright portion 41*a* and has an upper inside beveled portion 45*a* and lower escape portion 45*b*. An electric conduction ball member 46 made of elastic material such as rubber is disposed between the vibration plate 41 and the bottom of the recess 10*b* for grounding the vibration plate.

When the device is assembled, the vibration plate 41 and the cover 43 are integrated with each other by the engagement between the projected portion 41*b* and the leg portion 43*a*. The packing 45 is engaged with the recess 10*b* of the watch case 10 and the electric conduction ball member 46 is disposed on a suitable position of the bottom of the recess 10*b*. Then, the assembled vibration plate is engaged with the recess 10*b* with pressing against the packing 45. Thus, the vibration plate 41 is secured to the watch case 10 with a watertight sealing. The packing 45 having the escape portion 45*b* acts to urge the vibration plate 41 and cover 43 toward the bottom of the recess. Thus, the vibration plate and cover may be securely held in the recess without rising.

Figure 20:
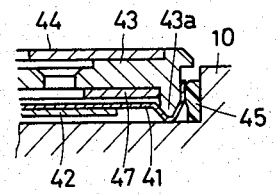
FIG. 20 is a sectional view showing a principal part of a fifth embodiment of the present invention.

In the fifth embodiment shown in FIG. 20, the cover 43 is made of plastics. The leg portion 43*a* of plastics is liable to be bent inwardly by the restitution force of the packing 45 to thereby decrease watertight effect. In order to prevent the bending of the leg portion 43*a* and to ensure the watertight, a reinforcement member 47 is engaged with the inside of the leg portion.

Figure 21:
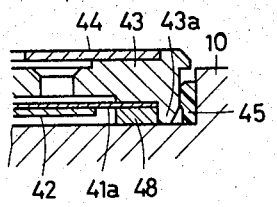
FIG. 21 is a sectional view showing a principal part of a sixth embodiment of the present invention.

The sixth embodiment of the present invention shown in FIG. 21 is similar to the fifth embodiment in construction having a reinforcement member 48. However, the vibration plate 41*a* is a flat plate and secured to the underside of the cover 43 with adhesives. The reinforcement member 48 is engaged with the vibration plate 41*a* and the inside of the leg portion 43*a* to maintain the vibration plate. The cover 43 engages directly with the packing 45 to be held in the recess 10*b* of the watch case.

Figure 22:
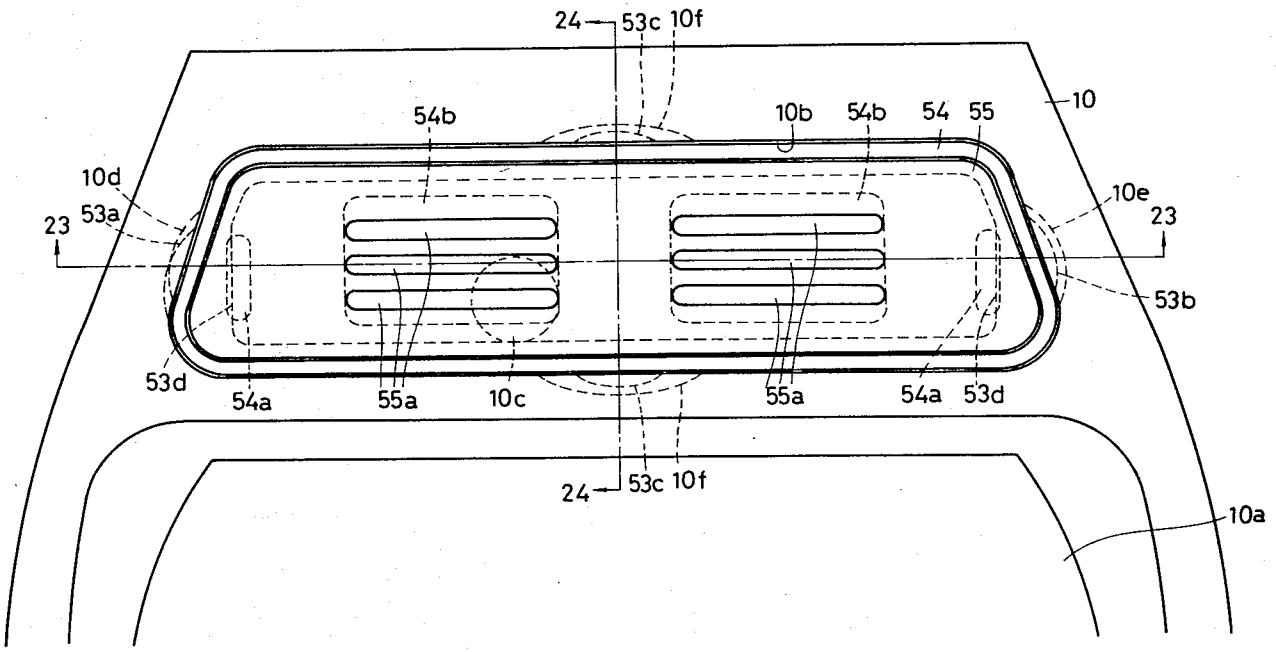
FIG. 22 is a front view showing a seventh embodiment of the present invention.
Figure 23:
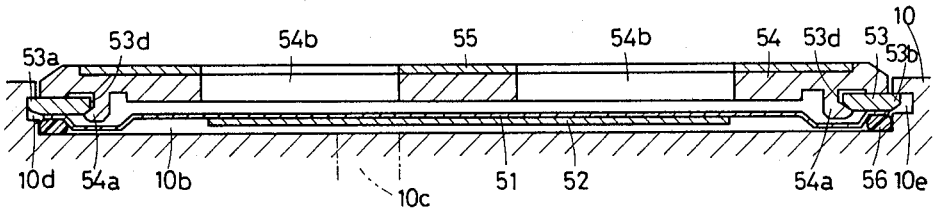
FIG. 23 is a sectional view taken along the line 23—23 of FIG. 22.
Figure 24:
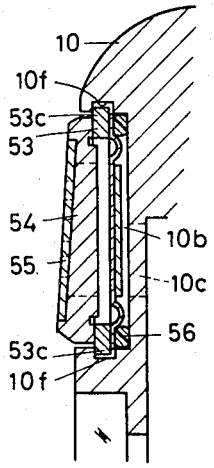
FIG. 24 is a sectional view taken along the line 24—24 of FIG. 22.

Referring to FIGS. 22 to 24 showing the seventh embodiment of the present invention, the recess 10*b* of the watch case 10 has a pair of notches 10*d* and 10*e* at longitudinal both sides and has a pair of notches 10*f* at lateral both sides. The notch 10*e* is larger than the notch 10*d*. The alarm device comprises a vibration plate 51 having a piezoelectric element 52, an annular fixing plate 53, a cover 54, and an ornament plate 55. The fixing plate 53 has a pair of lugs 53*a* and 53*b* engageable with notches 10*d* and 10*e* and has a pair of lugs 53*c* engageable with notches 10*f*. The cover 54 has a pair of hooks 54*a* each of which is engageable with an underside of inside 53*d* of the fixing plate 53 and has two sound emanating holes 54*b*. A plurality of sound emanating holes 55*a* are provided in the ornament plate 55 to communicate with sound emanating holes 54*b*.

When the device is mounted, an annular packing 56 is engaged with the bottom periphery of the recess 10*b*, on which the vibration plate 51 is put. Then, the lug 53*b* of the fixing plate 53 is first engaged with the larger notch 10*e*, thereafter lugs 53*c* are engaged with notches 10*f* and then the fixing plate 53 is slided to the left, so that the lug 53*a* may be engaged with the notch 10*d*. Thus, the fixing plate 53 is secured to the recess 10*b* of the watch case with compressing the packing 56. The cover 54 is pressed against the fixing plate 53, so that hooks 54*a* engage with insides 53*d* of the fixing plate 53. Since the cover 54 is engaged with the inside wall of the recess 10*b* to be restricted the movement, the fixing plate 53 cannot move in the recess. Thus, the assembled alarm device is secured to the recess 10*b* of the watch case.

Figure 25:
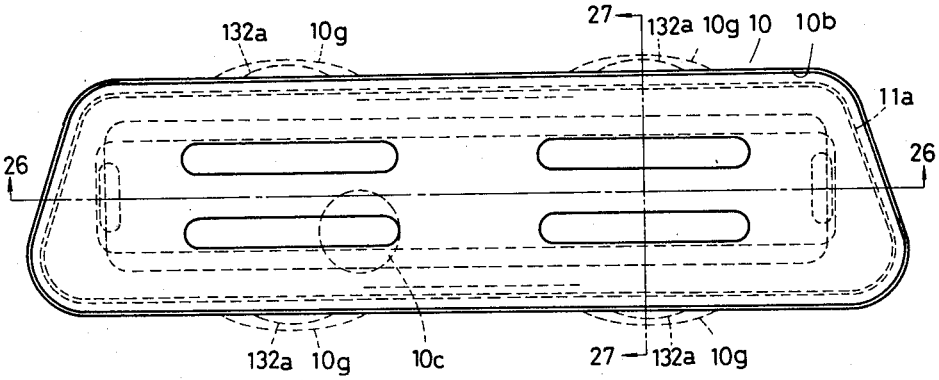
FIG. 25 is a front view showing an eighth embodiment of the present invention.
Figure 26:
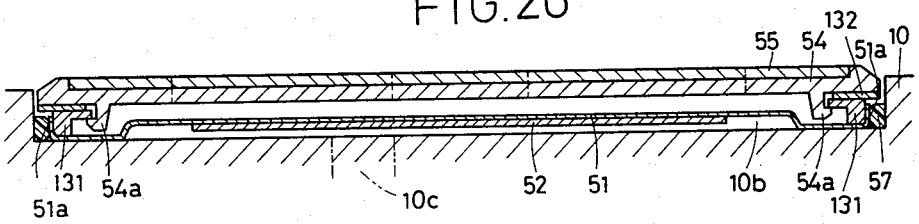
FIG. 26 is a sectional view taken along the line 26—26 of FIG. 26.
Figure 27:
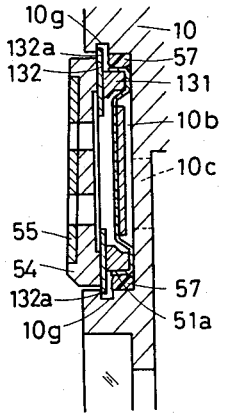
FIG. 27 is a sectional view taken along the line 27—27 of FIG. 25.

Referring to FIGS. 25 to 27 showing the eighth embodiment of the present invention, the recess 10*b* of the watch case has four lugs 10*g* at lateral both sides. The fixing plate comprises a first fixing plate 131 and a second fixing plate 132. The first fixing plate 131 is to be put on the vibration plate 51 and to be engaged by the hooks 54*a* of the cover 54. The second fixing plate 132 has lugs 132*a* to be engaged with notches 10*g* of the recess 10*b* for fixing the device to the recess. The vibration plate 51 has a peripheral upright portion 51*a* which is engageable with the outer periphery of the first fixing plate 131. A packing 57 to be engaged in the space between the inner wall of the recess 10*b* and the upright portion 51*a* of the vibration plate 51 has a thickness slightly greater than the space.

When the device is assembled, the packing 57 is engaged with the periphery of the bottom of the recess 10*b* and the first fixing plate 131 is engaged with the packing 57 together with the vibration plate 51. Thereafter the second fixing plate 132 is engaged with the recess by the engagement between the lugs 132*a* and the notches 10*g*. Thus, the fixing plate and vibration plate 51 may be secured to the recess 10*b* of the watch case with a watertight sealing with the packing 57. Finally, the cover 54 is pushed to the fixing plate, so that the hooks 54*a* may be engaged with the first fixing plate 131. Thus, the alarm device is secured to the recess 10*b*.

From the foregoing it will be understood that the present invention provides an acoustic alarm device which may be made into a small size with a watertight sealing and mounted on the upper portion of the watch case such as a band connecting portion. Thus, the space in the watch case may be effectively used so as to reduce the size of the watch.

What is claimed is:

1. An alarm device for a watch having a watch case, comprising a recess provided in an upper portion of the body of said watch case, a watertight sealing member provided in said recess, a vibration plate engaged with said watertight sealing member and adjacent to the bottom of said recess, cover means for said vibration plate, said cover means having at least one sound emanating opening, and means for securing said vibration plate and said cover means to said recess, whereby the entirety of said alarm device is embedded in said recess, said securing means being a screw provided with a watertight sealing means therefor and said cover means comprising a frame member which is secured to said recess by said screw, together with said vibration plate, and a cover which is secured to said frame member by frictional engagement.

2. The alarm device according to claim 1 wherein said vibration plate has a peripheral upright portion and is directly engaged with the bottom of said recess, and said watertight sealing member is disposed between said upright portion of said vibration plate and the inner wall of said recess.

3. The alarm device according to claim 1, wherein said cover means has a leg portion provided on the periphery thereof, said watertight sealing member being disposed between said leg portion and the inner wall of said recess, and said securing means being in frictional engagement between said leg portion and said watertight sealing member.

4. The alarm device according to claim 3 wherein said vibration plate has a peripheral upright portion engaged between the outside of said leg portion and said watertight sealing member.

5. The alarm device according to claim 6 further comprising a reinforcement member disposed inside said leg portion for preventing the inward bending of the leg portion.

6. The alarm device according to claim 1 wherein said recess is provided in an upper portion of the band connecting portion of the watch case.

7. The alarm device according to claim 1 further comprising an ornament plate secured to said cover means.

8. The alarm device according to claim 1 wherein the cover extends over the head of the screw.

9. The alarm device according to claim 1 wherein the cover is provided with a protrusion extending from the lower side thereof; said protrusion being in frictional engagement with the inside wall of the sound emanating openings.

10. An alarm device for a watch having a watch case, comprising a recess provided in an upper portion of the body of said watch case, a watertight sealing member provided in said recess, a vibration plate engaged with said watertight sealing member and adjacent to the bottom of said recess, cover means for said vibration plate, said cover means having at least one sound emanating opening, and means for securing said vibration plate and said cover means to said recess, said recess having notches in the inner wall thereof, said securing means being an annular fixing member having lugs which are engaged with said notches, and said cover means being provided with hooks engaging said fixing member.

11. The alarm device according to claim 10 wherein said fixing member comprises a first fixing plate engaged with said vibration plate and with said cover means, and a second fixing plate disposed on said first fixing plate and containing lugs engaged with said notches of said recess.

* * * * *